US011518955B2

(12) United States Patent
Schoeller et al.

(10) Patent No.: US 11,518,955 B2
(45) Date of Patent: Dec. 6, 2022

(54) POLYALKYL(METH)ACRYLATES FOR IMPROVING FUEL ECONOMY, DISPERSANCY AND DEPOSITS PERFORMANCE

(71) Applicant: Evonik Operations GmbH, Essen (DE)

(72) Inventors: Katrin Schoeller, Bad Soden (DE); Fabian Ziegler, Darmstadt (DE); Boris Eisenberg, Heppenheim (DE); Dmitriy Shakhvorostov, Darmstadt (DE); Klaus Schimossek, Bensheim (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 17/439,951

(22) PCT Filed: Mar. 18, 2020

(86) PCT No.: PCT/EP2020/057364
§ 371 (c)(1),
(2) Date: Sep. 16, 2021

(87) PCT Pub. No.: WO2020/187954
PCT Pub. Date: Sep. 24, 2020

(65) Prior Publication Data

US 2022/0195325 A1 Jun. 23, 2022

Related U.S. Application Data

(60) Provisional application No. 62/821,220, filed on Mar. 20, 2019.

(30) Foreign Application Priority Data

Aug. 15, 2019 (EP) ..... 19191924

(51) Int. Cl.
*C10M 145/14* (2006.01)
*C10N 20/04* (2006.01)
*C10N 40/25* (2006.01)

(52) U.S. Cl.
CPC .... *C10M 145/14* (2013.01); *C10M 2209/084* (2013.01); *C10N 2020/04* (2013.01); *C10N 2040/25* (2013.01)

(58) Field of Classification Search
CPC ..... C10M 145/14; C10M 2209/084; C10N 2020/04
See application file for complete search history.

(56) References Cited

U.S. PATENT DOCUMENTS

| | | | |
|---|---|---|---|
| 5,565,130 | A | 10/1996 | Omeis et al. |
| 5,597,871 | A | 1/1997 | Auschra et al. |
| 9,175,242 | B2 | 11/2015 | Radano et al. |
| 9,783,630 | B2 | 10/2017 | Stoehr et al. |
| 10,336,961 | B2 | 7/2019 | Nakada et al. |
| 10,633,610 | B2 | 4/2020 | Schöller et al. |
| 10,941,368 | B2 | 3/2021 | Yuki et al. |
| 10,975,325 | B2 | 4/2021 | Csihony et al. |
| 2008/0194443 | A1 | 8/2008 | Stohr et al. |
| 2010/0190671 | A1 | 7/2010 | Stoehr et al. |
| 2011/0306533 | A1 | 12/2011 | Eisenberg et al. |
| 2012/0258899 | A1 | 10/2012 | Eisenberg et al. |
| 2013/0196888 | A1 | 8/2013 | Truong-Dinh |
| 2016/0097017 | A1* | 4/2016 | Eisenberg ..... C10M 169/04 508/503 |
| 2019/0071615 | A1* | 3/2019 | Schöller et al. .. C08F 220/1804 |
| 2019/0177641 | A1* | 6/2019 | Klein ..... C10M 169/041 |
| 2019/0203148 | A1 | 7/2019 | Schöller et al. |
| 2019/0300808 | A1* | 10/2019 | Sondjaja ..... C10M 145/32 |
| 2019/0367836 | A1 | 12/2019 | Yuki et al. |
| 2020/0216596 | A1* | 7/2020 | Schbller ..... C10M 149/06 |
| 2020/0369977 | A1* | 11/2020 | Wieber ..... C10M 161/00 |
| 2021/0062106 | A1* | 3/2021 | Wieber ..... C08F 279/02 |
| 2022/0017654 | A1* | 1/2022 | Pletsch ..... C08F 236/08 |
| 2022/0017835 | A1* | 1/2022 | Pletsch ..... C10M 145/14 |

FOREIGN PATENT DOCUMENTS

| | | | |
|---|---|---|---|
| CN | 102459541 | A | 5/2012 |
| CN | 107406789 | A | 11/2017 |
| CN | 108473903 | A | 8/2018 |
| DE | 102009001447 | | 9/2010 |
| EP | 3 498 808 | | 12/2018 |
| EP | 3604487 | | 2/2020 |
| JP | 2014-210844 | | 11/2014 |

(Continued)

OTHER PUBLICATIONS

European Search Report dated January 29, 2020 in European Application No. 19191924.0, 9 pages.
XP 002796993, Database WPI, Week 201475, Thomson Scientific, London, GB; Clarivate Analytics, 2017, corresponding to JP 2014-210844 (previously submitted), 2 pages.
U.S. Appl. No. 13/202,744, filed Aug. 22, 2011, 2011/0306533, Eisenberg et al.
U.S. Pat. No. 10,941,368, Mar. 9, 2021, 2019/0367836, Yuki et al.
International Search Report issued in PCT/EP2020/057364 dated Jun. 9, 2020.
Written Opinion issued in PCT/EP2020/057364 dated Jun. 9, 2020.

* cited by examiner

*Primary Examiner* — Ellen M McAvoy
(74) *Attorney, Agent, or Firm* — Grüneberg and Myers PLLC

(57) ABSTRACT

Polyalkyl(meth)acrylates contain specified amounts of long-chain alkyl (meth)acrylates and functional monomers. Lubricant compositions can contain such polyalkyl(meth) acrylates, and the polyalkyl(meth)acrylates can be used as viscosity index (VI) improvers with good fuel economy as well as soot-dispersant function. The polyalkyl(meth)acrylates can provide equal or even unproved deposits in lubricant compositions, especially in engine oil (EO) compositions.

19 Claims, No Drawings

(56) References Cited

FOREIGN PATENT DOCUMENTS

| | | |
|---|---|---|
| WO | 2007/003238 | 1/2007 |
| WO | 2009/007147 | 1/2009 |
| WO | 2010/102903 | 9/2010 |
| WO | 2012/025901 | 3/2012 |
| WO | 2014/170169 | 10/2014 |
| WO | 2018/041755 | 3/2018 |
| WO | 2018/114673 | 6/2018 |

POLYALKYL(METH)ACRYLATES FOR IMPROVING FUEL ECONOMY, DISPERSANCY AND DEPOSITS PERFORMANCE

CROSS-REFERENCE TO RELATED APPLICATIONS

This application is the National Stage entry under § 371 of International Application No. PCT/EP2020/057364, filed on Mar. 18, 2020, and which claims the benefit of priority to U.S. Provisional Application No. 62/821,220, filed on Mar. 20, 2019; and to European Application No. EP19191924, filed on Aug. 15, 2019. The content of each of these applications is hereby incorporated by reference in its entirety.

BACKGROUND OF THE INVENTION

Field of the Invention

The present invention is directed to novel polyalkyl(meth) acrylates comprising specified amounts of long-chain alkyl (meth)acrylates and functional monomers, their preparation, lubricant compositions comprising such polyalkyl(meth) acrylates and their use as viscosity index (VI) improvers with good fuel economy as well as soot-dispersant function and equal or even improved deposits in lubricant compositions, especially in engine oil (EO) compositions.

It was an object of the present invention to develop VI improvers having good fuel economy, improved soot dispersancy and further good deposits, especially for diesel engine oils. In this connection, the solubility of such polymers was identified to be the greatest challenge.

Description of Related Art

The technology of polyalkyl(meth)acrylates comprising long-chain alkyl (meth)acrylates in general and their use as viscosity index improver is already known (US 2008/0194443, US 2010/0190671 and WO 2014/170169), although the dispersing effect of the polymers comprising styrene comonomers in lubricating formulations has never been described.

Lubricant properties are typically improved by the addition of additives to lubricating oils.

U.S. Pat. Nos. 5,565,130 and 5,597,871, for example, disclose using comb polymers comprising polybutadiene-derived macromonomers as viscosity index improvers. However, no dispersing effect is disclosed therein.

WO 2007/003238 A1 describes oil-soluble comb polymers based on polyolefin-based macromonomers, especially polybutadiene-based methacrylic esters, and C1-C10 alkyl methacrylates. The comb polymers can be used as an additive for lubricant oils, in order to improve the viscosity index and shear stability. However, no dispersing effect is disclosed therein.

WO 2009/007147 A1 discloses the use of comb polymers based on polyolefin-based macromonomers, especially polybutadiene-based methacrylic esters, and C1-C10 alkyl methacrylates for improving the fuel consumption of motor vehicles. However, no dispersing effect is disclosed therein.

WO 2010/102903 A1 discloses the use of comb polymers as antifatigue additives for transmission, motor and hydraulic oils. However, no dispersing effect is disclosed therein.

DE 10 2009 001 447 A1 describes the use of comb polymers for improving the load-bearing capacity of hydraulic oils having a high viscosity index. However, no dispersing effect is disclosed therein.

WO 2012/025901 A1 (Total) discloses the use of comb polymers in lubricants in combination with particular friction modifiers. However, no dispersing effect is disclosed therein.

SUMMARY OF THE INVENTION

Since the properties of the lubricants disclosed in the prior art are still unsatisfactory in relation to an improvement of dispersancy and deposits, especially in diesel engines, it is the aim of the present invention to provide single components which contribute significantly not only to fuel economy, but also to dispersancy and deposits performance when added to a base oil used in a lubricating composition.

It was surprisingly found that polyalkyl(meth)acrylates comprising specified amounts of long-chain alkyl (meth) acrylates and functional monomers have a positive impact on the dispersancy properties of a lubricating composition.

DETAILED DESCRIPTION OF THE INVENTION

A first object of the present invention is directed to polyalkyl(meth)acrylate polymers, comprising the following monomers:

(a) 10 to 25% by weight of esters of (meth)acrylic acid and a hydroxylated hydrogenated polybutadiene;
(b) 30% to 65% by weight of $C_{1-4}$ alkyl (meth)acrylates;
(c) 10% to 30% by weight of phenyl-containing monomers selected form the group consisting of styrene and benzyl (meth)acrylate), preferably styrene;
(d) 10% to 43% by weight of $C_{10-30}$ alkyl (meth)acrylates, preferably $C_{10-15}$ alkyl methacrylates, more preferably $C_{12-14}$ alkyl methacrylates; and
(e) 0% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

The weight-average molecular weight of the polyalkyl (meth)acrylate polymers according to the present invention is preferably in the range of 100,000 to 1,000,000 g/mol, more preferably in the range of 200,000 to 700,000 g/mol. The number-average molecular weight of the polyalkyl (meth)acrylate polymers according to the present invention is preferably in the range of 20,000 to 200,000 g/mol, more preferably in the range of 30,000 to 170,000 g/mol.

Preferably, the polyalkyl(meth)acrylate polymers according to the present invention have a polydipersity index (PDI) $M_w/M_n$ in the range of 2 to 10, more preferably in the range of 2 to 7. $M_w$ and $M_n$ are determined by size exclusion chromatography (SEC) using commercially available polymethylmethacrylate standards. The determination is effected by gel permeation chromatography with THF as eluent.

A further first embodiment is directed to polyalkyl(meth) acrylate polymers according to the present invention which comprise 55 to 65% by weight of monomers selected from the group consisting of $C_{1-4}$-alkyl (meth)acrylates, styrene and benzyl (meth)acrylate, preferably methyl methacrylate, butyl methacrylate and styrene.

A further first embodiment is directed to the polyalkyl (meth)acrylate polymers, comprising the following monomers:

(a) 10 to 25% by weight of esters of (meth)acrylic acid and a hydroxylated hydrogenated polybutadiene;
(b) 45% to 60% by weight of $C_{1-4}$ alkyl (meth)acrylates;
(c) 10% to 15% by weight of styrene;
(d) 15% to 30% by weight of $C_{10-30}$ alkyl (meth)acrylates, preferably $C_{10-15}$ alkyl methacrylates, more preferably $C_{12-14}$ alkyl methacrylates; and
(e) 3% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A further first embodiment is directed to the polyalkyl (meth)acrylate polymers, comprising the following monomers:

(a) 10 to 25% by weight of esters of (meth)acrylic acid and a hydroxylated hydrogenated polybutadiene;
(b) 30% to 45% by weight of $C_{1-4}$ alkyl (meth)acrylates;
(c) 19% to 30% by weight, preferably 20% to 30% by weight, of styrene;
(d) 15% to 30% by weight of $C_{10-30}$ alkyl (meth)acrylates, preferably $C_{10-15}$ alkyl methacrylates, more preferably C12-14 alkyl methacrylates; and
(e) 3% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A polyalkyl(meth)acrylate polymer in the context of this invention comprises a first polymer, which is also referred to as backbone or main chain, and a multitude of further polymers which are referred to as side chains and are bonded covalently to the backbone. In the present case, the backbone of the polyalkyl(meth)acrylate polymer is formed by the interlinked unsaturated groups of the mentioned (meth) acrylates. The ester groups of the (meth)acrylic esters, the phenyl radicals of the styrene monomers and the substituents of the further free-radically polymerizable comonomers form the side chains of the comb polymer.

The term "(meth)acrylate" refers to both, esters of acrylic acid and esters of methacrylic acid. Methacrylates are preferred over acrylates.

The hydroxylated hydrogenated polybutadiene for use in accordance with the invention has a number-average molar mass $M_n$ of 4,000 to 6,000 g/mol, preferably 4,500 to 5,000 g/mol. Because of their high molar mass, the hydroxylated hydrogenated polybutadienes can also be referred to as macroalcohols in the context of this invention.

The number-average molar mass $M_n$ is determined by size exclusion chromatography using commercially available polybutadiene standards. The determination is affected to DIN 55672-1 by gel permeation chromatography with THF as eluent.

Preferably, the hydroxylated hydrogenated polybutadiene has a hydrogenation level of at least 99%. An alternative measure of the hydrogenation level which can be determined on the copolymer of the invention is the iodine number. The iodine number refers to the number of grams of iodine which can be added onto 100 g of copolymer. Preferably, the copolymer of the invention has an iodine number of not more than 5 g of iodine per 100 g of copolymer. The iodine number is determined by the Wijs method according to DIN 53241-1:1995-05.

Preferred hydroxylated hydrogenated polybutadienes can be obtained according to GB 2270317.

Some hydroxylated hydrogenated polybutadienes are also commercially available. The commercially hydroxylated hydrogenated polybutadienes include, for example, a hydrogenated polybutadiene OH-functionalized to an extent of about 98% by weight (also called olefin copolymer OCP) having about 50% each of 1.2 repeat units and 1.4 repeat units, of $M_n$=4200 g/mol, from Cray Valley (Paris), a daughter company of Total (Paris).

Preference is given to monohydroxylated hydrogenated polybutadienes. More preferably, the hydroxylated hydrogenated polybutadiene is a hydroxyethyl- or hydroxypropyl-terminated hydrogenated polybutadiene. Particular preference is given to hydroxypropyl-terminated polybutadienes.

These monohydroxylated hydrogenated polybutadienes can be prepared by first converting butadiene monomers by anionic polymerization to polybutadiene. Subsequently, by reaction of the polybutadiene monomers with ethylene oxide or propylene oxide, a hydroxy-functionalized polybutadiene can be prepared. This hydroxylated polybutadiene can be hydrogenated in the presence of a suitable transition metal catalyst.

The esters of (meth)acrylic acid for use in accordance with the invention and a hydroxylated hydrogenated polybutadiene described are also referred to as macromonomers in the context of this invention because of their high molar mass.

The macromonomers for use in accordance with the invention can be prepared by transesterification of alkyl (meth)acrylates. Reaction of the alkyl (meth)acrylate with the hydroxylated hydrogenated polybutadiene forms the ester of the invention. Preference is given to using methyl (meth)acrylate or ethyl (meth)acrylate as reactant.

This transesterification is widely known. For example, it is possible for this purpose to use a heterogeneous catalyst system, such as lithium hydroxide/calcium oxide mixture (LiOH/CaO), pure lithium hydroxide (LiOH), lithium methoxide (LiOMe) or sodium methoxide (NaOMe) or a homogeneous catalyst system such as isopropyl titanate ($Ti(OiPr)_4$) or dioctyltin oxide ($Sn(OCt)_2O$).

The reaction is an equilibrium reaction. Therefore, the low molecular weight alcohol released is typically removed, for example by distillation.

In addition, the macromonomers can be obtained by a direct esterification proceeding, for example, from (meth) acrylic acid or (meth)acrylic anhydride, preferably under acidic catalysis by p-toluenesulfonic acid or methanesulfonic acid, or from free methacrylic acid by the DCC method (dicyclohexylcarbodiimide).

Furthermore, the present hydroxylated hydrogenated polybutadiene can be converted to an ester by reaction with an acid chloride such as (meth)acryloyl chloride.

Preferably, in the above-detailed preparations of the esters of the invention, polymerization inhibitors are used, for example the 4-hydroxy-2,2,6,6-tetramethylpiperidinooxyl radical and/or hydroquinone monomethyl ether.

The $C_{1-4}$ alkyl (meth)acrylates for use in accordance with the invention are esters of (meth)acrylic acid and straight chain or branched alcohols having 1 to 4 carbon atoms. The term "$C_{1-4}$ alkyl methacrylates" encompasses individual (meth)acrylic esters with an alcohol of a particular length, and likewise mixtures of (meth)acrylic esters with alcohols of different lengths. Suitable $C_{1-4}$ alkyl (meth)acrylates include, for example, methyl (meth)acrylate, ethyl (meth) acrylate, n-propyl (meth)acrylate), iso-propyl (meth)acrylate, n-butyl (meth)acrylate, iso-butyl (meth)acrylate and tert-butyl (meth)acrylate. Particularly preferred $C_{1-4}$ alkyl (meth)acrylates are methyl (meth)acrylate and n-butyl (meth)acrylate; methyl methacrylate and n-butyl methacrylate are especially preferred.

The $C_{10-30}$ alkyl (meth)acrylates for use in accordance with the invention are esters of (meth)acrylic acid and straight chain or branched alcohols having 10 to 30 carbon atoms. The term "$C_{10-30}$ alkyl methacrylates" encompasses individual (meth)acrylic esters with an alcohol of a particular length, and likewise mixtures of (meth)acrylic esters with alcohols of different lengths. Suitable $C_{10-30}$ alkyl (meth) acrylates include, for example, 2-butyloctyl (meth)acrylate, 2-hexyloctyl (meth)acrylate, decyl (meth)acrylate, 2-butyldecyl (meth)acrylate, 2-hexyldecyl (meth)acrylate, 2-octyldecyl (meth)acrylate, undecyl (meth)acrylate, 5-methylundecyl (meth)acrylate, dodecyl (meth)acrylate, 2-methyldodecyl (meth)acrylate, 2-hexyldodecyl (meth) acrylate, 2-octyldodecyl (meth)acrylate, tridecyl (meth) acrylate, 5-methyltridecyl (meth)acrylate, tetradecyl (meth) acrylate, 2-decyltetradecyl (meth)acrylate, pentadecyl (meth)acrylate, hexadecyl (meth)acrylate, 2-methylhexadecyl (meth)acrylate, 2-dodecylhexadecyl (meth)acrylate, heptadecyl (meth)acrylate, 5-isopropylheptadecyl (meth) acrylate, 4-tert-butyloctadecyl (meth)acrylate, 5-ethyloctadecyl (meth)acrylate, 3-isopropyloctadecyl (meth)acrylate, octadecyl (meth)acrylate, 2-decyloctadecyl (meth)acrylate, 2-tetradecyloctadecyl (meth)acrylate, nonadecyl (meth) acrylate, eicosyl (meth)acrylate, cetyleicosyl (meth)acrylate, stearyleicosyl (meth)acrylate, docosyl (meth)acrylate and/or eicosyltetratriacontyl (meth)acrylate. 2-decyl-tetradecyl (meth)acrylate, 2-decyloctadecyl (meth)acrylate, 2-dodecyl-1-hexadecyl (meth)acrylate, 1,2-octyl-1-dodecyl (meth) acrylate, 2-tetradecylocadecyl (meth)acrylate, 1,2-tetradecyl-octadecyl (meth)acrylate and 2-hexadecyl-eicosyl (meth)acrylate.

The $C_{10-15}$ alkyl methacrylates for use in accordance with the invention are esters of methacrylic acid and alcohols having 10 to 15 carbon atoms. The term "$C_{10-15}$ alkyl methacrylates" encompasses individual methacrylic esters with an alcohol of a particular length, and likewise mixtures of methacrylic esters with alcohols of different lengths.

The suitable $C_{10-15}$ alkyl methacrylates include, for example, decyl methacrylate, undecyl methacrylate, 5-methylundecyl methacrylate, dodecyl methacrylate, 2-methyldodecyl methacrylate, tridecyl methacrylate, 5-methyltridecyl methacrylate, tetradecyl methacrylate and/or pentadecyl methacrylate.

Particularly preferred $C_{10-15}$ alkyl methacrylates are methacrylic esters of a linear $C_{12-14}$ alcohol mixture ($C_{12-14}$ alkyl methacrylate).

Suitable styrene monomers are selected from the group consisting of styrene, substituted styrenes having an alkyl substituent in the side chain, for example alpha-methylstyrene and alpha-ethylstyrene, substituted styrenes having an alkyl substituent on the ring, such as vinyltoluene and para-methylstyrene, halogenated styrenes, for example monochlorostyrenes, dichlorostyrenes, tribromostyrenes and tetrabromostyrenes; styrene being preferred.

The polyalkyl(meth)acrylate polymers for use in accordance with the invention can be characterized on the basis of its molar branching level ("f-branch"). The molar branching level refers to the percentage in mol % of macromonomers (component (a)) used, based on the total molar amount of all the monomers in the monomer composition. The molar amount of the macromonomers used is calculated on the basis of the number-average molar mass $M_n$ of the macromonomers. The calculation of the branching level is described in detail in WO 2007/003238 A1, especially on pages 13 and 14, to which reference is made here explicitly.

The polyalkyl(meth)acrylate based comb polymers in accordance with the invention preferably have a molar degree of branching $f_{branch}$ of 0.1 to 2 mol %, more preferably 0.3 to 1.5 mol % and most preferably 0.5 to 1.0 mol %.

The molar degree of branching $f_{branch}$ is calculated as described in US 2010/0190671 A1 in paragraphs [0060] to [0065].

The polymers according to the present invention are characterized by their contribution to low $KV_{40}$, $HTHS_{80}$ and $HTHS_{100}$ values (e.g. at a given $HTHS_{150}$ of 2.6 mPas) of lubricating oil compositions comprising them.

The polyalkyl(meth)acrylate polymers according to the present invention can therefore be used in all common grades of motor oils having the viscosity characteristics defined in the document SAE J300. The polyalkyl(meth) acrylate polymers according to the present invention do further improve dispersancy and deposit formation of lubricating oil compositions.

The polyalkyl(meth)acrylate polymers according to the present invention do further improve dispersancy and deposit formation in engines, preferably in diesel engines.

A further object of the present invention is therefore directed to the use of polyalkyl(meth)acrylate polymers according to the present invention to improve the kinematic viscosity and HTHS performance of lubricating oil compositions whilst improving dispersancy performance and keeping or improving deposit formation, especially of engine oil formulations.

A further object of the present invention is directed to a method of improving the kinematic viscosity and HTHS performance whilst improving dispersancy performance and keeping or improving deposit formation of lubricating oil compositions, especially of engine oil formulations, by adding a polyalkyl(meth)acrylate polymer according to the present invention.

A second embodiment of the present invention is directed to an additive composition, comprising:

(A) 60% to 80% by weight of a base oil, and (B) 20% to 40% by weight of a polyalkyl(meth)acrylate polymer, comprising the following monomers:

- (a) 10 to 25% by weight of esters of (meth)acrylic acid and a hydroxylated hydrogenated polybutadiene;
- (b) 30% to 65% by weight of $C_{1-4}$ alkyl (meth)acrylates;
- (c) 10% to 30% by weight of phenyl-containing monomers selected form the group consisting of styrene and benzyl (meth)acrylate), preferably styrene;
- (d) 10% to 43% by weight of $C_{10-30}$ alkyl (meth)acrylates, preferably $C_{10-15}$ alkyl methacrylates, more preferably $C_{12-14}$ alkyl methacrylates; and (e) 0% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

The content of each component (A) and (B) is based on the total weight of the additive composition.

In a particular embodiment, the proportions of components (A) and (B) add up to 100% by weight.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A further second embodiment of the present invention is directed to an additive composition, comprising:

(A) 60% to 80% by weight of a base oil, and (B) 20% to 40% by weight of a polyalkyl(meth)acrylate polymer, comprising the following monomers:

(a) 10 to 25% by weight of esters of (meth)acrylic acid and a hydroxylated hydrogenated polybutadiene;

(b) 45% to 60% by weight of $C_{1-4}$ alkyl (meth)acrylates;

(c) 10% to 15% by weight of styrene;

(d) 15% to 30% by weight of $C_{10-30}$ alkyl (meth)acrylates, preferably $C_{10-15}$ alkyl methacrylates, more preferably $C_{12-14}$ alkyl methacrylates; and (e) 3% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

The content of each component (A) and (B) is based on the total weight of the additive composition.

In a particular embodiment, the proportions of components (A) and (B) add up to 100% by weight.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A further second embodiment of the present invention is directed to an additive composition, comprising:

(A) 60% to 80% by weight of a base oil, and (B) 20% to 40% by weight of a polyalkyl(meth)acrylate polymer, comprising the following monomers:

(a) 10 to 25% by weight of esters of (meth)acrylic acid and a hydroxylated hydrogenated polybutadiene;

(b) 30% to 45% by weight of $C_{1-4}$ alkyl (meth)acrylates;

(c) 19% to 30% by weight, preferably 20% to 30% by weight, of styrene;

(d) 15% to 30% by weight of $C_{10-30}$ alkyl (meth)acrylates, preferably $C_{10-15}$ alkyl methacrylates, more preferably $C_{12-14}$ alkyl methacrylates; and (e) 3% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

The content of each component (A) and (B) is based on the total weight of the additive composition.

In a particular embodiment, the proportions of components (A) and (B) add up to 100% by weight.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

The base oil to be used in the additive composition comprises an oil of lubricating viscosity. Such oils include natural and synthetic oils, oil derived from hydrocracking, hydrogenation, and hydro-finishing, unrefined, refined, re-refined oils or mixtures thereof.

The base oil may also be defined as specified by the American Petroleum Institute (API) (see April 2008 version of "Appendix E-API Base Oil Interchangeability Guidelines for Passenger Car Motor Oils and Diesel Engine Oils", section 1.3 Sub-heading 1.3. "Base Stock Categories").

The API currently defines five groups of lubricant base stocks (API 1509, Annex E—API Base Oil Interchangeability Guidelines for Passenger Car Motor Oils and Diesel Engine Oils, September 2011). Groups I, II and III are mineral oils which are classified by the amount of saturates and sulphur they contain and by their viscosity indices; Group IV are polyalphaolefins; and Group V are all others, including e.g. ester oils. The table below illustrates these API classifications.

| Group | Saturates | Sulphur content | Viscosity Index (VI) |
|---|---|---|---|
| I | <90% | >0.03% | 80-120 |
| II | at least 90% | not more than 0.03% | 80-120 |
| III | at least 90% | not more than 0.03% | at least 120 |
| IV | All polyalphaolefins (PAOs) | | |
| V | All others not included in Groups I, II, III or IV (e.g. ester oils) | | |

The kinematic viscosity at 100° C. ($KV_{100}$) of appropriate apolar base oils used to prepare an additive composition or lubricating composition in accordance with the present invention is preferably in the range of 3 $mm^2/s$ to 10 $mm^2/s$, more preferably in the range of 4 $mm^2/s$ to 8 $mm^2/s$, according to ASTM D445.

Further base oils which can be used in accordance with the present invention are Group II-Ill Fischer-Tropsch derived base oils.

Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the lubricating composition of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156, WO 01/57166 and WO 2013/189951.

Especially for engine oil formulations are used base oils of API Group III.

The additive composition of the present invention comprises preferably 70% to 75% by weight, of the base oil (A) and 25% to 30% by weight, of the polyalkyl(meth)acrylate polymer (B), based on the total weight of the additive composition.

A third embodiment of the present invention is directed to a lubricating oil composition, comprising:

(A) 80 to 99.5% by weight of a base oil;

(B) 0.5 to 5% by weight of a polyalkyl(meth)acrylate polymer, comprising the following monomers:

(a) 10 to 25% by weight of esters of (meth)acrylic acid and a hydroxylated hydrogenated polybutadiene;

(b) 30% to 65% by weight of $C_{1-4}$ alkyl (meth)acrylates;

(c) 10% to 30% by weight of phenyl-containing monomers selected form the group consisting of styrene and benzyl (meth)acrylate), preferably styrene;

(d) 10% to 43% by weight of $C_{10-30}$ alkyl (meth)acrylates, preferably $C_{10-15}$ alkyl methacrylates, more preferably C12-14 alkyl methacrylates; and (e) 0% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA; and (C) 0 to 15% by weight of one or more further additives.

The content of each component (A), (B) and (C) is based on the total composition of the lubricating oil composition.

In a particular embodiment, the proportions of components (A), (B) and (C) add up to 100% by weight.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A further third embodiment of the present invention is directed to a lubricating oil composition, comprising:

(A) 80 to 99.5% by weight of a base oil;

(B) 0.5 to 5% by weight of a polyalkyl(meth)acrylate polymer, comprising the following monomers:

(a) 10 to 25% by weight of esters of (meth)acrylic acid and a hydroxylated hydrogenated polybutadiene;

(b) 45% to 60% by weight of $C_{1-4}$ alkyl (meth)acrylates;

(c) 10% to 15% by weight of styrene;

(d) 15% to 30% by weight of $C_{10-30}$ alkyl (meth)acrylates, preferably $C_{10-15}$ alkyl methacrylates, more preferably $C_{12-14}$ alkyl methacrylates; and (e) 3% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA; and (C) 0 to 15% by weight of one or more further additives.

The content of each component (A), (B) and (C) is based on the total composition of the lubricating oil composition.

In a particular embodiment, the proportions of components (A), (B) and (C) add up to 100% by weight.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A further third embodiment of the present invention is directed to a lubricating oil composition, comprising:

(A) 80 to 99.5% by weight of a base oil;

(B) 0.5 to 5% by weight of a polyalkyl(meth)acrylate polymer, comprising the following monomers:

(a) 10 to 25% by weight of esters of (meth)acrylic acid and a hydroxylated hydrogenated polybutadiene;

(b) 30% to 45% by weight of $C_{1-4}$ alkyl (meth)acrylates;

(c) 19% to 30% by weight, preferably 20% to 30% by weight, of styrene;

(d) 15% to 30% by weight of $C_{10-30}$ alkyl (meth)acrylates, preferably $C_{10-15}$ alkyl methacrylates, more preferably $C_{12-14}$ alkyl methacrylates; and (e) 3% to 7% by weight of N-containing monomers selected from the group consisting of N,N-dimethylaminoethyl methacrylate (DMAEMA), N-(3-(dimethylamino)propyl)methacrylamide (DMAPMAm) and N-vinylpyrrolidinone (NVP), preferably DMAEMA.

(C) 0 to 15% by weight of one or more further additives.

The content of each component (A), (B) and (C) is based on the total composition of the lubricating oil composition.

In a particular embodiment, the proportions of components (A), (B) and (C) add up to 100% by weight.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

The lubricating oil composition according to the invention may also contain, as component (C), further additives selected from the group consisting of conventional VI improvers, dispersants, defoamers, detergents, antioxidants, pour point depressants, antiwear additives, extreme pressure additives, friction modifiers, anticorrosion additives, dyes and mixtures thereof.

Conventional VI improvers include hydrogenated styrene-diene copolymers (HSDs, U.S. Pat. Nos. 4,116,917, 3,772,196 and 4,788,316), especially based on butadiene and isoprene, and also olefin copolymers (OCPs, K. Marsden: "Literature Review of OCP Viscosity Modifiers", Lubrication Science 1 (1988), 265), especially of the poly (ethylene-co-propylene) type, which may often also be present in N/O-functional form with dispersing action, or PAMAs, which are usually present in N-functional form with advantageous additive properties (boosters) as dispersants, wear protection additives and/or friction modifiers (DE 1 520 696 to Rohm and Haas, WO 2006/007934 to RohMax Additives).

Compilations of VI improvers and pour point improvers for lubricant oils, especially motor oils, are detailed, for example, in T. Mang, W. Dresel (eds.): "Lubricants and Lubrication", Wiley-VCH, Weinheim 2001: R. M. Mortier, S. T. Orszulik (eds.): "Chemistry and Technology of Lubricants", Blackie Academic & Professional, London 1992; or J. Bartz: "Additive für Schmierstoffe", Expert-Verlag, Renningen-Malmsheim 1994.

Appropriate dispersants include poly(isobutylene) derivatives, for example poly(isobutylene)succinimides (PIBSIs), including borated PIBSIs; and ethylene-propylene oligomers having N/O functionalities.

Dispersants (including borated dispersants) are preferably used in an amount of 0 to 5% by weight, based on the total amount of the lubricating oil composition.

Suitable defoamers are silicone oils, fluorosilicone oils, fluoroalkyl ethers, etc.

The defoaming agent is preferably used in an amount of 0.005 to 0.1% by weight, based on the total amount of the lubricating oil composition.

The preferred detergents include metal-containing compounds, for example phenoxides; salicylates; thiophosphonates, especially thiopyrophosphonates, thiophosphonates and phosphonates; sulfonates and carbonates. As metal, these compounds may contain especially calcium, magnesium and barium. These compounds may preferably be used in neutral or overbased form.

Detergents are preferably used in an amount of 0.2 to 1% by weight, based on the total amount of the lubricating oil composition.

The suitable antioxidants include, for example, phenol-based antioxidants and amine-based antioxidants.

Phenol-based antioxidants include, for example, octadecyl-3-(3,5-di-tert-butyl-4-hydroxyphenyl)propionate; 4,4'-methylenebis(2,6-di-tert-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butyl phenol); 4,4'-butyl idenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl -4-methylphenol; 2,6-di-t-butyl-4-ethyl-phenol; 2,4-dimethyl-6-t-butylphenol; 2,6-di-t-amyl-p-cresol; 2,6-di-t-butyi-4-(N,N'-dimethylaminomethylphenol); 4,4'thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl) sulfide; bis(3,5-di-t-butyl-4-hydroxybenzyl) sulfide; n-octyl-3-(4-hydroxy -3,5-di-t-butylphenyl)propionate; n-octadecyl-3-(4-hydroxy-3,5-di-t-butylphenyl)propionate; 2,2'-thio[diethyl-bis-3-(3,5-di-t-butyl-4-hydroxyphenyl) propionate], etc. Of those, especially preferred are bisphenol-based antioxidants and ester group containing phenol-based antioxidants. The amine-based antioxidants include, for example, monoalkyldiphenylamines such as monooctyldiphenylamine, monononyldiphenylamine, etc.; dialkyldiphenylamines such as 4,4'-dibutyldiphenylamine, 4,4'-dipentyldiphe nylamine, 4,4'-dihexyldiphenylamine, 4,4'-diheptyldiphenylamine, 4,4'-dioctyldiphenylamine, 4,4'-dinonyldiphenylamine, etc.; polyalkyldiphenylamines such as tetrabutyldiphenylamine, tetrahexyldiphenylamine, tetraoctyldiphenylamine, tetranonyldiphenylamine, etc.; naphthylamines, concretely alpha-naphthylamine, phenyl-alpha-naphthylamine and further alkyl-substituted phenyl-alpha-naphthylamines such as butylphenyl-alpha-naphthylamine, pentylphenyl-alpha-naphthylamine, hexylphenyl-alpha-naphthylamine, heptylphenyl-alpha-naphthylamine, octylphenyl-alpha-naphthylamine, nonylphenyl-alpha-naphthylamine, etc. Of those, diphenylamines are preferred to naphthylamines, from the viewpoint of the antioxidation effect thereof.

Suitable antioxidants may further be selected from the group consisting of compounds containing sulfur and phosphorus, for example metal dithiophosphates, for example zinc dithiophosphates (ZnDTPs), "OOS triesters"=reaction products of dithiophosphoric acid with activated double bonds from olefins, cyclopentadiene, norbornadiene, a-pinene, polybutene, acrylic esters, maleic esters (ashless on combustion); organosulfur compounds, for example dialkyl sulfides, diaryl sulfides, polysulfides, modified thiols, thiophene derivatives, xanthates, thioglycols, thioaldehydes, sulfur-containing carboxylic acids; heterocyclic sulfur/nitrogen compounds, especially dialkyldimercaptothiadiazoles, 2-mercaptobenzimidazoles; zinc bis(dialkyldithiocarbamate) and methylene bis(dialkyldithiocarbamate); organophosphorus compounds, for example triaryl and trialkyl phosphites; organocopper compounds and overbased calcium- and magnesium-based phenoxides and salicylates.

Antioxidants are used in an amount of 0 to 15% by weight, preferably 0.1 to 10% by weight, more preferably 0.5 to 5% by weight, based on the total amount of the lubricating oil composition.

The pour-point depressants include ethylene-vinyl acetate copolymers, chlorinated paraffin-naphthalene condensates, chlorinated paraffin-phenol condensates, polymethacrylates, polyalkylstyrenes, etc. Preferred are polymethacrylates having a mass-average molecular weight of from 5.000 to 50.000 g/mol.

The amount of the pour point depressant is preferably from 0.1 to 5% by weight, based on the total amount of the lubricating oil composition.

The preferred antiwear and extreme pressure additives include sulfur-containing compounds such as zinc dithiophosphate, zinc di-$C_{3-12}$-alkyldithiophosphates (ZnDTPs), zinc phosphate, zinc dithiocarbamate, molybdenum dithiocarbamate, molybdenum dithiophosphate, disulfides, sulfurized olefins, sulfurized oils and fats, sulfurized esters, thiocarbonates, thiocarbamates, polysulfides, etc.; phosphorus-containing compounds such as phosphites, phosphates, for example trialkyl phosphates, friaryl phosphates, e.g. tricresyl phosphate, amine-neutralized mono- and dialkyl phosphates, ethoxylated mono- and dialkyl phosphates, phosphonates, phosphines, amine salts or metal salts of those compounds, etc.; sulfur and phosphorus-containing anti-wear agents such as thiophosphites, thiophosphates, thiophosphonates, amine salts or metal salts of those compounds, etc.

The antiwear agent may be present in an amount of 0 to 3% by weight, preferably 0.1 to 1.5% by weight, more preferably 0.5 to 0.9% by weight, based on the total amount of the lubricating oil composition.

Friction modifiers used may include mechanically active compounds, for example molybdenum disulfide, graphite (including fluorinated graphite), poly(trifluoroethylene), polyamide, polyimide; compounds that form adsorption layers, for example long-chain carboxylic acids, fatty acid esters, ethers, alcohols, amines, amides, imides; compounds which form layers through tribochemical reactions, for example saturated fatty acids, phosphoric acid and thiophosphoric esters, xanthogenates, sulfurized fatty acids; compounds that form polymer-like layers, for example ethoxylated dicarboxylic partial esters, dialkyl phthalates, methacrylates, unsaturated fatty acids, sulfurized olefins or organometallic compounds, for example molybdenum compounds (molybdenum dithiophosphates and molybdenum dithiocarbamates MoDTCs) and combinations thereof with ZnDTPs, copper-containing organic compounds.

Friction modifiers may be used in an amount of 0 to 6% by weight, preferably 0.05 to 4% by weight, more preferably 0.1 to 2% by weight, based on the total amount of the lubricating oil composition.

Some of the compounds listed above may fulfil multiple functions. ZnDTP, for example, is primarily an antiwear additive and extreme pressure additive, but also has the character of an antioxidant and corrosion inhibitor (here: metal passivator/deactivator).

The above-detailed additives are described in detail, inter alia, in T. Mang, W. Dresel (eds.): "Lubricants and Lubrication", Wiley-VCH, Weinheim 2001; R. M. Mortier, S. T. Orszulik (eds.): "Chemistry and Technology of Lubricants".

Preferably, the total concentration of the one or more additives (C) is 0.05% to 15% by weight, more preferably 3% to 10% by weight, based on the total weight of the lubricating oil composition.

The polyalkyl(meth)acrylate based comb polymers in accordance with the invention can in general be prepared by free-radical polymerization and by related methods of controlled free-radical polymerization, for example ATRP (=atom transfer radical polymerization) or RAFT (=reversible addition fragmentation chain transfer).

Standard free-radical polymerization is detailed, inter alia, in Ullmann's Encyclopedia of Industrial Chemistry, Sixth Edition. In general, a polymerization initiator and optionally a chain transfer agent are used for this purpose.

The ATRP method is known per se. It is assumed that this is a "living" free-radical polymerization, but no restriction is intended by the description of the mechanism. In these processes, a transition metal compound is reacted with a compound having a transferable atom group. This involves transfer of the transferable atom group to the transition metal compound, as a result of which the metal is oxidized. This reaction forms a free radical which adds onto ethylenic groups. However, the transfer of the atom group to the transition metal compound is reversible, and so the atom group is transferred back to the growing polymer chain, which results in formation of a controlled polymerization system. It is accordingly possible to control the formation of the polymer, the molecular weight and the molecular weight distribution.

This reaction regime is described, for example, by J.-S. Wang, et al., J. Am. Chem. Soc, vol. 117, p. 5614-5615 (1995), by Matyjaszewski, Macromolecules, vol. 28, p. 7901-7910 (1995). In addition, patent applications WO 96/30421, WO 97/47661, WO 97/18247, WO 98/40415 and WO 99/10387 disclose variants of the above-elucidated ATRP. In addition, the polymers of the invention can also be obtained via RAFT methods, for example. This method is described in detail, for example, in WO 98/01478 and WO 2004/083169.

The polymerization can be conducted under standard pressure, reduced pressure or elevated pressure. The polymerization temperature is also uncritical. In general, however, it is in the range from −20 to 200° C., preferably 50 to 150° C. and more preferably 80 to 130° C.

A further object of the present invention is directed to a process for improving deposit formation of a lubricating oil composition by adding a polyalkyl(meth)acrylate polymer, comprising the following monomers:

(a) 10 to 25% by weight of esters of (meth)acrylic acid and a hydroxylated hydrogenated polybutadiene;

(b) 45% to 60% by weight of $C_{1-4}$ alkyl (meth)acrylates;

(c) 10% to 15% by weight of styrene;

(d) 15% to 30% by weight of $C_{10-30}$ alkyl (meth)acrylates, preferably $C_{10-15}$ alkyl methacrylates, more preferably $C_{12-14}$ alkyl methacrylates; and (e) 3% to 7% by weight of DMAEMA.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

A further object of the present invention is directed to a process for improving deposit formation of a lubricating oil composition by adding a polyalkyl(meth)acrylate polymer, comprising the following monomers:

(a) 10 to 25% by weight of esters of (meth)acrylic acid and a hydroxylated hydrogenated polybutadiene;

(b) 30% to 45% by weight of $C_{1-4}$ alkyl (meth)acrylates;

(c) 19% to 30% by weight, preferably 20% to 30% by weight, of styrene;

(d) 15% to 30% by weight of $C_{10-30}$ alkyl (meth)acrylates, preferably $C_{10-15}$ alkyl methacrylates, more preferably $C_{12-14}$ alkyl methacrylates; and (e) 3% to 7% by weight of DMAEMA.

The content of each component (a), (b), (c), (d) and (e) is based on the total composition of the polyalkyl(meth)acrylate based comb polymer.

In a particular embodiment, the proportions of components (a), (b), (c), (d) and (e) add up to 100% by weight.

The invention has been illustrated by the following non-limiting examples.

EXPERIMENTAL PART

Abbreviations

AMA alkyl methacrylate
BnMA benzyl methacrylate
$C_1$ AMA $C_1$-alkyl methacrylate=methyl methacrylate (MMA)
$C_4$ AMA $C_4$-alkyl methacrylate=n-butyl methacrylate
$C_{12-15}$ AMA $C_{12-15}$-alkyl methacrylate
DDM dodecanethiol
DMAEMA dimethylaminoethyl methacrylate
DMAPMA N-(3-(Dimethylamino)propyl)methacrylamide
Gr III Oil Group III base oil mixture (NB 3043 and NB 3080 from Neste) with a $KV_{100}$ of 4.9 cSt
$HTHS_{80}$ high-temperature high-shear viscosity @80° C., measured according to CEC L-036
$HTHS_{100}$ high-temperature high-shear viscosity @100° C., measured according to CEC L-036
$HTHS_{150}$ high-temperature high-shear viscosity @150° C., measured according to CEC L-036
KV kinematic viscosity measured according to ASTM D445
$KV_{40}$ kinematic viscosity @40° C., measured according to ISO 3104
$KV_{100}$ kinematic viscosity @100° C., measured according to ISO 3104
$M_n$ number-average molecular weight
$M_w$ weight-average molecular weight
NB 3020 Nexbase® 3020, Group III base oil from Neste with a $KV_{100}$ of 2.2 cSt
NB 3043 Nexbase® 3043, Group III base oil from Neste with a $KV_{100}$ of 4.3 cSt
NVP N-vinyl-2-pyrrolidinone
P6003 DI Package for PCMO, ACEA C3, commercially available from Infineum
PCMO Passenger car motor oils
PDI Polydispersity index
Sty styrene
VI viscosity index, measured according to ISO 2909
Yubase 4+ Group III base oil from SK Lubricants with a $KV_{100}$ of 4.2 cSt

Test Methods

The polyalkyl(meth)acrylates according to the present invention and the comparative examples were characterized with respect to their molecular weight and PDI.

Molecular weights were determined by size exclusion chromatography (SEC) using commercially available polymethylmethacrylate (PMMA) standards. The determination is affected by gel permeation chromatography with THF as eluent (flow rate: 1 mL/min; injected volume: 100 μl).

The additive compositions including the polyalkyl(meth) acrylates according to the present invention and comparative examples were characterized with respect to their viscosity index (VI) to ASTM D 2270, kinematic viscosity at 40° C. ($KV_{40}$) and 100° C. ($KV_{100}$) to ASTM D445 and with respect to their shear stability.

To show the shear stability of the additive compositions, the PSSI (Permanent Shear Stability Index) was calculated according to ASTM D 6022-01 (Standard Practice for Calculation of Permanent Shear Stability Index) based on data measured according to ASTM D 2603-B (Standard Test Method for Sonic Shear Stability of Polymer-Containing Oils).

The lubricating oil compositions including the polyalkyl (meth)acrylates according to the present invention and comparative examples were characterized with respect to kinematic viscosity at 40° C. ($KV_{40}$) and 100° C. ($KV_{100}$) to ASTM D445, the viscosity index (VI) to ASTM D 2270 and high-temperature high-shear viscosity at 80° C., 100° C. and 150° C. to CEC L-036. Dispersancy testing was carried out by using VULCANO (dried at 130-160° C. in the oven prior to treatment) carbon black. 5% were added to the finished formulations and Rheometer scans were measured on rheometer C25 Bohlin geometry over shear rates from 0 to 920 $s^{-1}$ at 100° C.

The area under the curve was calculated via trapezoidal method for quantification of the results.

To estimate the engine deposit-forming tendency of the lubricating oil compositions on pistons, the microcoker test GFC-LU-27-A-13 was used as a screener.

Solubility was tested in solutions of 3.75% polymer in PAO4. The solutions were analyzed photometrically after cooling down to room temperature for at least 1 day and the haze value was obtained using a Hunter LAB XE device and software. When measuring haze, the percentage of light diffusely scattered compared to the total light transmitted is reported. When the Haze level is below 5 the sample appears completely clear by eye. At Haze levels between 5-10, the sample appears very slightly hazy and above 10 the sample appears slightly hazy.

Synthesis of a Hydroxylated Hydrogenated Polybutadiene

The macroalcohol prepared was a hydroxypropyl-terminated hydrogenated polybutadiene having a mean molar mass $M_n$=4750 g/mol.

The macroalcohol was synthesized by an anionic polymerization of 1,3-butadiene with butyllithium at 20-45° C. On attainment of the desired degree of polymerization, the reaction was stopped by adding propylene oxide and lithium was removed by precipitation with methanol. Subsequently, the polymer was hydrogenated under a hydrogen atmosphere in the presence of a noble metal catalyst at up to 140° C. and pressure 200 bar. After the hydrogenation had ended, the noble metal catalyst was removed and organic solvent was drawn off under reduced pressure. Finally, the base oil NB 3020 was used for dilution to a polymer content of 70% by weight.

The vinyl content of the macroalcohol was 61%, the hydrogenation level >99% and the OH functionality >98%. These values were determined by H-NMR (nuclear resonance spectroscopy).

Synthesis of Macromonomer (MM)

In a 2 L stirred apparatus equipped with saber stirrer, air inlet tube, thermocouple with controller, heating mantle, column having a random packing of 3 mm wire spirals, vapor divider, top thermometer, reflux condenser and substrate cooler, 1000 g of the above-described macroalcohol are dissolved in 450 g of methyl methacrylate (MMA) by stirring at 60° C. Added to the solution are 20 ppm of 2,2,6,6-tetramethylpiperidin-1-oxyl radical and 200 ppm of hydroquinone monomethyl ether. After heating to MMA reflux (bottom temperature about 110° C.) while passing air through for stabilization, about 20 g of MMA are distilled off for azeotropic drying. After cooling to 95° C., 0.30 g of $LiOCH_3$ is added and the mixture is heated back to reflux. After the reaction time of about 1 hour, the top temperature has fallen to ~64° C. because of methanol formation. The methanol/MMA azeotrope formed is distilled off constantly until a constant top temperature of about 100° C. is established again. At this temperature, the mixture is left to react for a further hour. For further workup, the bulk of MMA is drawn off under reduced pressure. Insoluble catalyst residues are removed by pressure filtration (Seitz T1000 depth filter). The content of NB 3020 "entrained" into the copolymer syntheses described further down was taken into account accordingly.

Synthesis of Polyalkyl(Meth)Acrylate Polymers which do NOT Contain NVP

An apparatus with 4-neck flask and precision glass saber stirrer is initially charged with a 87.5 g mixture of low molecular weight monomers and macromonomer whose composition is shown in Table 1, and with 58.3 g of an oil mixture of Hydroseal G232H/NB3020/NB3043=65.56:15.36:19.09. After heating to 95° C. under nitrogen, 0.2 g of tert-butylperoxy-2-ethyl-hexanoate is added and the temperature is maintained. Another 87.5 g of the monomer, 58.3 g of the oil mixture and 0.2 g tert-butylperoxy-2-ethyl-hexanoate is added within 3 hours. Then the reaction is maintained at 95° C. for another 2 h. Subsequently, the reaction mixture is diluted to 40% solids with NB3043 and 0.2% tert-butylperoxy-2-ethyl-hexanoate within 3 hours. Then the reaction is maintained at 95° C. for another 2 h and after this another 0.2% tert-butylperoxy-2-ethyl-hexanoate is added and the mixture is stirred at 95° C. overnight. The next day, the mixture is diluted to 25% solids with NB3043. 700 g of a 25% solution of comb polymers in mineral oil are obtained. The monomer components will add up to 100%. The amounts of initiator and dilution oil are given relative to the total amount of monomers.

Synthesis of Polyalkyl(Meth)Acrylate Polymers which do Contain NVP

An apparatus with 4-neck flask and precision glass saber stirrer is initially charged with a 87.5 g mixture of low molecular weight monomers and macromonomer whose composition is shown in Table 1, and with 58.3 g of an oil mixture of Hydroseal G232H/NB3020/NB3043=65.56:15.36:19.09. After heating to 95° C. under nitrogen, 0.2 g of tert-butylperoxy-2-ethyl-hexanoate is added and the temperature is maintained. Another 87.5 g of the monomer, 58.3 g of the oil mixture and 0.2 g tert-butylperoxy-2-ethyl-hexanoate is added within 3 hours. Then the reaction is maintained at 95° C. for another 2 h. Subsequently, the reaction mixture is diluted to 30% solids with NB3043 and 0.2% tert-butylperoxy-2-ethyl-hexanoate within 3 hours. The reaction mixture is then heated to 130° C. and NVP is added (1% relative to monomer), subsequently 0.5% tert-butyl peroxybenzoate is added and the reaction temperature is hold for at least 60 min. In a second step NVP is added (1% relative to monomer), subsequently 0.5% tert-butyl peroxybenzoate is added and the reaction temperature is hold for at least 60 min. In a third step NVP is added (1% relative to monomer), subsequently 0.5% tert-butyl peroxybenzoate is added and the reaction temperature is hold for at least 60 min. Then 0.25% tert-butyl peroxybenzoate is added and the reaction temperature is hold for at least 60 min. Then the temperature is decreased to 120° C. and 0.4% 2,2-bis(t-butylperoxy)butane (50% solution in white oil) is added and the reaction temperature is hold for at least 60 min. Then again 0.8% 2,2-bis(t-butylperoxy)butane (50% solution in white oil) is added and the reaction is stirred over night at 120° C. The next day, the mixture is diluted to 25% solids with NB3043. The amounts of initiator and dilution oil are given relative to the total amount of monomers.

Table 1 shows the reaction mixtures used to prepare working examples and comparative examples.

The monomer components will add up to 100%. The amount of initiator is given relative to the total amount of monomers. The remaining amount (about 75%) is dilution oil as described above in the general proceedings used to prepare the polymers.

TABLE 1

Reaction mixtures used to prepare working examples and comparative examples.

| Ex # | MM [%] | Sty [%] | BnMA [%] | NVP [%] | DMAEMA [%] | DMAPMA [%] | C12-14 AMA [%] | C4 AMA [%] | C1 AMA [%] |
|---|---|---|---|---|---|---|---|---|---|
| 1 | 15.0 | 11.0 | — | — | — | — | 30.0 | 43.8 | 0.2 |
| 2 | 14.5 | 10.7 | — | 3.0 | — | — | 29.1 | 42.5 | 0.2 |
| 3 | 14.8 | 10.8 | — | 1.5 | — | — | 29.6 | 43.1 | 0.2 |
| 4 | 15.0 | 11.0 | — | — | 3.4 | — | 15.0 | 55.4 | 0.2 |
| 5 | 15.0 | 11.0 | — | — | 3.4 | — | 25.0 | 45.4 | 0.2 |
| 6 | 15.00 | 11.0 | — | — | 3.4 | — | 17.00 | 53.40 | 0.20 |
| 7 | 15.00 | 11.0 | — | — | 6.0 | — | 17.00 | 50.80 | 0.20 |
| 8 | 15.0 | 11.0 | — | — | — | 3.4 | 15.0 | 55.4 | 0.2 |
| 9 | 15.0 | 11.0 | — | — | — | 3.4 | 25.0 | 45.4 | 0.2 |
| 10 | 15.0 | 0.2 | 10.0 | — | — | — | 15.0 | 59.6 | 0.2 |
| 11 | 15.0 | 20.0 | — | — | — | — | 22.9 | 41.9 | 0.2 |
| 12 | 14.8 | 19.7 | — | 1.5 | — | — | 29.5 | 34.3 | 0.2 |
| 13 | 14.6 | 19.4 | — | 3.0 | — | — | 29.0 | 33.8 | 0.2 |
| 14 | 14.55 | 19.4 | — | 3.0 | — | — | 29.1 | 33.76 | 0.19 |
| 15 | 13.58 | 19.4 | — | 3.0 | — | — | 26.19 | 37.64 | 0.19 |
| 16 | 13.58 | 19.4 | — | 3.0 | — | — | 22.31 | 41.52 | 0.19 |
| 16a | 13.6 | 19.4 | — | 3.0 | — | — | 22.3 | 41.5 | 0.2 |
| 17 | 15.0 | 0.2 | 20.0 | — | — | — | 25.0 | 39.6 | 0.2 |
| 18 | 15.0 | 22.5 | — | — | — | — | 23.9 | 38.4 | 0.2 |
| 19 | 15.0 | 25.0 | — | — | — | — | 24.9 | 34.9 | 0.2 |
| 20 | 15.0 | 27.5 | — | — | — | — | 25.9 | 31.4 | 0.2 |
| 21 | 15.0 | 27.5 | — | — | — | — | 25.9 | 31.4 | 0.2 |
| 21a | 13.9 | 27.9 | — | — | — | — | 26.2 | 31.8 | 0.2 |
| 22 | 14.55 | 26.68 | — | 3.0 | — | — | 21.83 | 33.75 | 0.19 |
| 23 | 24.0 | 10.0 | — | — | — | — | 10.1 | 55.7 | 0.2 |
| 24 | 24.0 | 20.0 | — | — | — | — | 10.1 | 45.7 | 0.2 |
| 25 | 24.0 | 30.0 | — | — | — | — | 10.1 | 35.7 | 0.2 |
| 26 | 15.0 | 0.2 | — | — | — | 3.4 | 15.0 | 66.2 | 0.2 |
| 27 | 42.0 | 39.8 | — | — | — | — | 0.2 | 17.8 | 0.2 |
| 28 | 41.0 | 34.6 | — | — | 3.4 | — | 2.6 | 18.2 | 0.2 |
| 29 | 38.5 | 11.0 | — | — | 3.4 | — | 4.9 | 42.0 | 0.2 |
| 30 | 42.0 | 20.0 | — | — | — | — | 0.2 | 37.6 | 0.2 |
| 31 | 42.0 | 30.0 | — | — | — | — | 0.2 | 27.6 | 0.2 |
| 32 | 42.0 | 10.0 | — | — | — | — | 0.2 | 47.6 | 0.2 |
| 33 | 24.0 | 40.0 | — | — | — | — | 10.1 | 25.7 | 0.2 |
| 34 | 23.5 | 1.3 | — | 2.0 | — | — | 9.9 | 63.1 | 0.2 |

The net compositions of the resulting comb polymers as well as their characteristic number-average molecular weights $M_n$, weight-average molecular weights $M_w$ and their polydispersity indices (PDI) are summarized in the following Table 2.

Table 2 further shows the macromonomer conversion rate $MM_{conv}$ of the polyalkyl(meth)acrylate polymers.

Examples 1-25 are working examples and their compositions are within the described ranges.

Examples 26 is a comparative example as the styrene content is much lower than the described range.

Examples 27-32 are comparative examples as their macromonomer contents are higher than the described range.

Example 33 is a comparative example as its styrene content is higher than the described range.

Example 34 is a comparative example as its styrene content is lower than the described range.

The composition of comparative example 27 corresponds to that of example 6 as disclosed in US 2010/0190671.

The composition of comparative example 28 corresponds to that of example 1 as disclosed in US 2016/0097017.

The composition of comparative example 29 corresponds to that of example 3 as disclosed in US 2016/0097017.

TABLE 2

Net compositions of the comb polymers prepared according to the present invention.

| Ex # | $MM_{conv.}$ [%] | MM [%] | Styrene [%] | BnMA [%] | NVP [%] | DMAEMA [%] | DMAPMA [%] | C12-14 AMA [%] | C4 AMA [%] | C1 AMA [%] | $M_n$ [g/mol] | $M_w$ [g/mol] | PDI |
|---|---|---|---|---|---|---|---|---|---|---|---|---|---|
| 1 | 92 | 14.0 | 11.1 | — | — | — | — | 30.4 | 44.3 | 0.2 | 97200 | 254000 | 2.6 |
| 2 | 95 | 13.9 | 10.8 | — | 3.0 | — | — | 29.3 | 42.8 | 0.2 | 104000 | 459000 | 4.4 |
| 3 | 95 | 14.1 | 10.9 | — | 1.5 | — | — | 29.8 | 43.5 | 0.2 | 109000 | 429000 | 3.9 |
| 4 | 90 | 13.7 | 11.2 | — | — | 3.5 | — | 15.2 | 56.2 | 0.2 | 126000 | 463000 | 3.69 |
| 5 | 91 | 13.8 | 11.2 | — | — | 3.5 | — | 25.3 | 46.0 | 0.2 | 92200 | 391000 | 4.24 |
| 6 | 88.0 | 13.4 | 11.2 | — | — | 3.5 | — | 17.3 | 54.4 | 0.2 | 145000 | 616000 | 4.24 |
| 7 | 90.0 | 13.7 | 11.2 | — | — | 6.1 | — | 17.3 | 51.5 | 0.2 | 160000 | 560000 | 3.5 |
| 8 | 88 | 13.4 | 11.2 | — | — | — | 3.5 | 15.3 | 56.4 | 0.2 | 148000 | 486000 | 3.3 |
| 9 | 86 | 13.2 | 11.2 | — | — | — | 3.5 | 25.5 | 46.4 | 0.2 | 138000 | 460000 | 3.4 |
| 10 | 86.0 | 13.2 | 2.0 | 10.2 | — | — | — | 15.3 | 60.9 | 0.2 | 136000 | 477000 | 3.5 |
| 11 | 88 | 13.4 | 20.4 | — | — | — | — | 23.3 | 42.7 | 0.2 | 99200 | 268000 | 2.7 |

TABLE 2-continued

Net compositions of the comb polymers prepared according to the present invention.

| Ex # | $MM_{conv.}$ [%] | MM [%] | Styrene [%] | BnMA [%] | NVP [%] | DMAEMA [%] | DMAPMA [%] | C12-14 AMA [%] | C4 AMA [%] | C1 AMA [%] | $M_n$ [g/mol] | $M_w$ [g/mol] | PDI |
|---|---|---|---|---|---|---|---|---|---|---|---|---|---|
| 12 | 95 | 14.1 | 19.9 | — | 1.5 | — | — | 29.8 | 34.5 | 0.2 | 95600 | 357000 | 3.7 |
| 13 | 95 | 14.3 | 19.4 | — | 3.0 | — | — | 29.2 | 33.9 | 0.2 | 93200 | 402000 | 4.3 |
| 14 | 92.0 | 13.5 | 19.6 | — | 3.0 | — | — | 29.5 | 34.2 | 0.2 | 33900 | 223000 | 6.58 |
| 15 | 90.0 | 12.4 | 19.7 | — | 3.0 | — | — | 26.5 | 38.2 | 0.2 | 91100 | 311000 | 3.42 |
| 16 | 90.0 | 12.4 | 19.7 | — | 3.0 | — | — | 22.6 | 42.1 | 0.2 | 92500 | 309000 | 3.34 |
| 16a | 93 | 12.8 | 19.6 | — | 3.9 | — | — | 22.5 | 41.9 | 0.2 | 43600 | 184000 | 4.2 |
| 17 | 89.0 | 13.6 | 2.0 | 20.3 | — | — | — | 25.4 | 40.3 | 0.2 | 159000 | 511000 | 3.2 |
| 18 | 86 | 13.2 | 23.0 | — | — | — | — | 24.4 | 39.2 | 0.2 | 98200 | 260000 | 2.7 |
| 19 | 86 | 13.2 | 25.5 | — | — | — | — | 25.4 | 35.7 | 0.2 | 113000 | 321000 | 2.8 |
| 20 | 88 | 13.4 | 28.0 | — | — | — | — | 26.4 | 32.0 | 0.2 | 106000 | 304000 | 2.9 |
| 21 | 90 | 13.7 | 27.9 | — | — | — | — | 26.3 | 31.9 | 0.2 | 106000 | 405000 | 3.8 |
| 21a | 95 | 13.3 | 28.1 | — | — | — | — | 26.4 | 32.0 | 0.2 | 70000 | 226000 | 3.2 |
| 22 | 90.0 | 13.3 | 27.1 | — | 3.0 | — | — | 22.2 | 34.2 | 0.2 | 33300 | 197000 | 5.93 |
| 23 | 88.0 | 21.8 | 10.3 | — | — | — | — | 10.4 | 57.3 | 0.2 | 143000 | 341000 | 2.4 |
| 24 | 85.0 | 21.2 | 20.7 | — | — | — | — | 10.5 | 47.4 | 0.2 | 110000 | 263000 | 2.38 |
| 25 | 85.0 | 21.2 | 31.1 | — | — | — | — | 10.5 | 37 | 0.2 | 113000 | 267000 | 2.35 |
| 26*) | 88 | 13.4 | 0.2 | — | — | — | 3.5 | 15.3 | 67.4 | 0.2 | 164000 | 589000 | 3.6 |
| 27*) | 96.0 | 41.0 | 40.5 | — | — | — | — | 0.2 | 18.1 | 0.2 | 71700 | 208000 | 2.9 |
| 28*) | — | 41.0 | 34.6 | — | — | 3.4 | — | 2.6 | 18.2 | 0.2 | | | |
| 29*) | — | 38.5 | 11.0 | — | — | 3.4 | — | 4.9 | 42.0 | 0.2 | | | |
| 30*) | 83.0 | 37.5 | 21.6 | — | — | — | — | 0.2 | 40.5 | 0.2 | 127000 | 284000 | 2.25 |
| 31*) | 79.0 | 36.4 | 32.9 | — | — | — | — | 0.2 | 30.3 | 0.2 | 118000 | 267000 | 2.26 |
| 32*) | 87.0 | 38.7 | 10.6 | — | — | — | — | 0.2 | 50.3 | 0.2 | 151000 | 358000 | 2.4 |
| 33*) | 87.0 | 21.6 | 41.3 | — | — | — | — | 10.4 | 26.5 | 0.2 | 76300 | 186000 | 2.44 |
| 34*) | 92.0 | 22.1 | 1.3 | — | 2.0 | — | — | 10.1 | 64.3 | 0.2 | 115000 | 965000 | 8.4 |

*)comparative example

Table 3 summarizes the characteristics of additive compositions comprising examples and comparative examples (3.75% by weight of polymer in base oil). As base oil was used a Group III oil mixture with $KV_{100}$ of 4.9 cSt.

TABLE 3

Typical properties of the working examples and comparative examples.

| Ex # | MM [%] | Styrene [%] | C4 AMA [%] | C12-14 AMA [%] | $KV_{100}$ [$mm^2/s$] | $KV_{40}$ [$mm^2/s$] | VI | HAZE |
|---|---|---|---|---|---|---|---|---|
| 1 | 14.0 | 11.1 | 44.3 | 30.4 | 8.57 | 33.04 | 254 | 2.63 |
| 2 | 13.9 | 10.7 | 42.8 | 29.3 | 9.45 | 33.75 | 283 | 6.86 |
| 3 | 14.1 | 10.9 | 43.5 | 29.8 | 9.35 | 34.13 | 276 | 2.22 |
| 4 | 13.7 | 11.2 | 56.2 | 15.2 | 7.33 | 28.28 | 243 | 4.55 |
| 5 | 13.8 | 11.1 | 46.0 | 25.3 | 8.73 | 30.08 | 291 | 2.08 |
| 6 | 13.4 | 11.2 | 54.4 | 17.3 | 7.88 | 28.56 | 269 | 5.05 |
| 7 | 13.7 | 11.2 | 51.5 | 17.3 | 7.73 | 28.56 | 262 | 2.48 |
| 8 | 13.4 | 11.2 | 56.4 | 15.3 | 6.83 | 27.85 | 220 | 3.04 |
| 9 | 13.2 | 11.2 | 46.4 | 25.5 | 8.82 | 29.80 | 300 | 0.98 |
| 10 | 13.2 | 2.0 | 60.9 | 15.3 | 6.56 | 27.67 | 206 | 3.67 |
| 11 | 13.4 | 20.4 | 42.7 | 23.3 | 7.88 | 29.03 | 264 | 1.89 |
| 12 | 14.1 | 19.8 | 34.5 | 29.8 | 8.89 | 33.28 | 265 | 8.98 |
| 13 | 14.3 | 19.5 | 33.9 | 29.2 | 8.92 | 33.0 | 269 | 3.02 |
| 14 | 13.5 | 19.6 | 34.2 | 29.5 | 8.16 | 32.63 | 240 | 3.09 |
| 15 | 12.4 | 19.7 | 38.2 | 26.5 | 8.28 | 30.94 | 262 | 5.36 |
| 16 | 12.4 | 19.7 | 42.1 | 22.6 | 7.85 | 29.73 | 254 | 5.75 |
| 16a | 12.8 | 19.6 | 41.9 | 22.5 | 7.81 | 30.02 | 249 | 3.84 |
| 17 | 13.6 | 2.0 | 40.3 | 25.4 | 6.95 | 28.35 | 222 | 2.21 |
| 18 | 13.2 | 23.0 | 39.2 | 24.4 | 7.90 | 29.30 | 262 | 1.64 |
| 19 | 13.2 | 25.5 | 35.6 | 25.4 | 8.30 | 29.63 | 278 | 4.03 |
| 20 | 13.4 | 28.0 | 32.0 | 26.4 | 8.35 | 30.14 | 275 | 4.26 |
| 21 | 13.7 | 27.9 | 31.9 | 26.3 | 8.90 | 30.49 | 295 | 3.32 |
| 21a | 13.3 | 28.1 | 32.0 | 26.4 | 8.02 | 30.77 | 252 | 5.95 |
| 22 | 13.3 | 27.1 | 34.2 | 22.2 | 7.34 | 29.55 | 231 | 1.14 |
| 23 | 21.8 | 10.3 | 57.3 | 10.4 | 7.62 | 28.64 | 255 | 1.4 |
| 24 | 21.2 | 20.7 | 47.4 | 10.5 | 7.14 | 28.37 | 232 | 0 |
| 25 | 21.2 | 31.1 | 37 | 10.5 | 6.65 | 27.33 | 215 | 0.43 |
| 26*) | 13.4 | 0.2 | 67.4 | 15.3 | 7.24 | 28.12 | 241 | 2.33 |
| 27*) | 41.0 | 40.5 | 18.1 | 0.2 | 7.84 | 33.2 | 220 | 4.85 |
| 28*) | 41.0 | 34.6 | 18.2 | 2.6 | — | — | — | — |
| 29*) | 38.5 | 11.0 | 42.0 | 4.9 | — | — | — | — |
| 30*) | 37.5 | 21.6 | 40.5 | 0.2 | 7.17 | 29.68 | 220 | 0 |
| 31*) | 36.4 | 32.9 | 30.3 | 0.2 | 6.54 | 28.10 | 200 | 0.21 |

TABLE 3-continued

Typical properties of the working examples and comparative examples.

| Ex # | MM [%] | Styrene [%] | C4 AMA [%] | C12-14 AMA [%] | $KV_{100}$ [$mm^2/s$] | $KV_{40}$ [$mm^2/s$] | VI | HAZE |
|---|---|---|---|---|---|---|---|---|
| 32*) | 38.7 | 10.6 | 50.3 | 0.2 | 8.07 | 31.88 | 243 | 0 |
| 33*) | 21.6 | 41.3 | 26.5 | 10.4 | 6.59 | 27.98 | 204 | 2.24 |
| 34*) | 22.0 | 1.3 | 64.3 | 10.1 | 9.20 | 30.80 | 305 | 0 |

*)comparative example

From Table 3 it can be seen that polyalkyl(methacrylate) polymers with a macromonomer content of around 14% by weight and a styrene content of about 11% by weight the $KV_{40}$ is decreasing with increasing BMA content (see Examples 1 to 10 and Examples 11 to 17). A low $KV_{40}$ is an indicator for good fuel economy (see US 2010/0190671).

It can be further seen that increasing the styrene content and decreasing the BMA content whilst keeping the macromonomer content does not change the $KV_{40}$ values significantly (see Examples 18 to 25).

The "HAZE" was identified to be a good indicator for the oil solubility of the polyalkyl(methacrylate) polymers.

Evaluation of VI Improvers in Formulations

To demonstrate the effect of the polyalkyl(methacrylate) polymers according to the present invention on the $KV_{40}$ and $HTHS_{100}$ performance of lubricating oil compositions different formulation examples were prepared and the corresponding values are measured. Formulations with Nexbase 3043 as base oil were prepared by using formulation targets 0W20 according to SAE J300; i.e. it was formulated on an $HTHS_{150}$ target of 2.6 mPas by adding the additives as described in Table 3 above. No DI package was used. The resulting polymer content was typically between 3 and 5% by weight. Characteristic E0 formulation properties ($KV_{40}$, $KV_{100}$, $HTHS_{100}$, $HTHS_{80}$) were measured and are summarized in Table 4.

From Table 4 it can be seen that by using polyalkyl (methacrylate) polymers with a macromonomer content of around 14% by weight and a styrene content of about 11% by weight the $KV_{40}$, $HTHS_{80}$ and $HTHS_{100}$ values are decreasing with increasing BMA content (see Formulation Examples A-1 to A-8 and Formulation Examples A-9 to A-12). A low $KV_{40}$ is an indicator for good fuel economy. The values for the area under the curve of the dispersancy testings are decreasing accordingly.

A styrene content of about 10% is not enough to get good dispersancy performance. It can be seen from Table 4 that the addition of N-functionalized monomers leads to better results in dispersancy testing.

It can be further seen that increasing the styrene content and decreasing the BMA content whilst keeping the macromonomer content does not change the $KV_{40}$, $HTHS_{80}$ and $HTHS_{100}$ values significantly (see Formulation Examples A-13 to A-19).

Further formulations with Yubase 4+ as base oil were prepared by using formulation targets 0W20 according to SAE J300; i.e. it was formulated on an $HTHS_{150}$ target of 2.6 mPas by adding the additives as described in Table 3 above and using a DI package. The resulting polymer content was typically between 1 and 2% by weight. Characteristic EO formulation properties ($KV_{40}$, $KV_{100}$, $HTHS_{100}$, $HTHS_{80}$) were measured and are summarized in Table 5.

Additionally, the dispersancy results show that the presence of an N-functionalized monomer like NVP, DMAPMA and DMAEMA leads to better results compared to polymers without them. The best results could be achieved by using DMAEMA as N-functionalized monomer.

TABLE 4

Engine oil formulations A without DI package in Nexbase 3043 as base oil, adjusted to $HTHS_{150}$ = 2.6 mPas.

| Formulation # | Ex # | polymer content [%] | $HTHS_{150}$ [mPas] | $HTHS_{100}$ [mPas] | $HTHS_{80}$ [mPas] | $KV_{100}$ [$mm^2/s$] | $KV_{40}$ [$mm^2/s$] | VI | Carbon black dispersancy (area under curve) |
|---|---|---|---|---|---|---|---|---|---|
| A-1 | 1 | — | — | — | — | — | — | — | 42.80 |
| A-2 | 2 | 3.4 | 2.57 | 4.98 | 7.09 | 8.17 | 27.83 | 294 | 32.32 |
| A-3 | 3 | 3.27 | 2.65 | 4.96 | 7.12 | 7.820 | 27.45 | 280 | 34.01 |
| A-4 | 4 | 3.25 | 2.59 | 4.35 | 6.31 | 6.44 | 23.56 | 251 | n.d. |
| A-5 | 5 | 3.15 | 2.63 | 4.78 | 6.57 | 7.37 | 24.74 | 293 | 8.40 |
| A-6 | 8 | 3.25 | 2.64 | 4.15 | 6.13 | 5.99 | 23.08 | 226 | 27.84 |
| A-7 | 9 | 3.43 | 2.64 | 4.82 | 6.50 | 7.77 | 24.75 | 317 | 27.32 |
| A-8 | 10 | 4.08 | 2.62 | 4.32 | 6.39 | 6.30 | 23.97 | 235 | 28.13 |
| A-9 | 11 | 3.45 | 2.64 | 4.83 | 6.56 | 6.99 | 24.44 | 273 | 21.62 |
| A-10 | 12 | 3.45 | 2.59 | 5.07 | 7.20 | 8.31 | 31.71 | 256 | 29.97 |
| A-11 | 13 | 3.65 | 2.63 | 5.08 | 7.27 | 8.02 | 27.89 | 286 | n.d. |
| A-12 | 17 | 4.08 | 2.63 | 4.35 | 6.48 | 6.72 | 24.58 | 255 | 26.71 |
| A-13 | 18 | 3.45 | 2.58 | 4.77 | 6.54 | 6.96 | 24.64 | 270 | 32.13 |
| A-14 | 19 | 3.23 | 2.59 | 4.78 | 6.50 | 7.06 | 24.52 | 278 | 23.93 |
| A-15 | 20 | 3.23 | 2.57 | 4.84 | 6.62 | 7.05 | 24.82 | 273 | 25.62 |
| A-16 | 21 | 3.03 | 2.57 | 4.78 | 6.54 | 7.26 | 24.68 | 287 | 25.43 |
| A-17 | 23 | 3.25 | 2.6 | 4.58 | 6.56 | 6.658 | 24.05 | 258 | 9.60 |
| A-18 | 24 | 3.63 | 2.57 | 4.54 | 6.48 | 6.52 | 24.16 | 247 | n.d. |
| A-19 | 25 | 4.13 | 2.62 | 4.56 | 6.47 | 6.43 | 24.02 | 243 | 16.82 |
| A-20*) | 26 | 3.78 | 2.59 | 4.41 | 6.40 | 6.90 | 23.98 | 276 | 35.28 |
| A-21*) | 27 | 4.63 | 2.55 | 5.14 | 7.45 | 7.28 | 28.4 | 240 | 30.77 |

TABLE 4-continued

Engine oil formulations A without DI package in Nexbase 3043 as base oil, adjusted to $HTHS_{150}$ = 2.6 mPas.

| Formulation # | Ex # | polymer content [%] | $HTHS_{150}$ [mPas] | $HTHS_{100}$ [mPas] | $HTHS_{80}$ [mPas] | $KV_{100}$ [$mm^2/s$] | $KV_{40}$ [$mm^2/s$] | VI | Carbon black dispersancy (area under curve) |
|---|---|---|---|---|---|---|---|---|---|
| A-22*) | 28 | | | | | | | | 9.89 |
| A-23*) | 29 | 3.69 | 2.58 | 4.75 | 7.02 | 6.64 | 25.58 | 236 | n.d. |
| A-24*) | 30 | 4.0 | 2.59 | 4.80 | 6.9 | 6.92 | 26.42 | 243 | 8.09 |
| A-25*) | 31 | 4.88 | 2.57 | 4.76 | 6.73 | 6.70 | 25.94 | 235 | 14.36 |
| A-26*) | 32 | — | — | — | — | — | — | — | 9.46 |
| A-27*) | 33 | 4.25 | 2.6 | 4.77 | 6.82 | 6.462 | 24.97 | 232 | 38.35 |
| A-28*) | 34 | 3.25 | 2.59 | 4.56 | 6.5 | 7.868 | 25.20 | 315 | 37.95 |

*)comparative example
n.d. = not detected

TABLE 5

Engine oil formulations B with DI package (12.3% by weight of P6003) with Yubase 4+ as base oil, adjusted to $HTHS_{150}$ = 2.6 mPas.

| Formulation # | Ex # | polymer content [%] | $HTHS_{150}$ [mPas] | $HTHS_{100}$ [mPas] | $HTHS_{80}$ [mPas] | $KV_{100}$ [$mm^2/s$] | $KV_{40}$ [$mm^2/s$] | VI | MCT results: Average merit | MCT results: Average deposit Temperature [° C.] |
|---|---|---|---|---|---|---|---|---|---|---|
| B-1 | 2 | 1.5 | 2.62 | 5.54 | 8.17 | 8.05 | 34.99 | 215 | 8.4 | 252 |
| B-2 | 4 | 1.55 | 2.68 | 5.43 | 8.16 | 7.63 | 32.56 | 216 | 8.5 | 261 |
| B-3 | 5 | 1.578 | 2.69 | 5.28 | 8.02 | 7.35 | 31.53 | 211 | 8.9 | 264 |
| B-4 | 6 | 1.575 | 2.68 | 5.24 | 7.99 | 7.31 | 31.51 | 209 | 8.7 | 259 |
| B-5 | 7 | 1.8 | 2.73 | 5.30 | 8.09 | 7.54 | 31.97 | 216 | 8.8 | 266 |
| B-6 | 8 | 1.55 | 2.68 | 5.43 | 8.16 | 7.63 | 32.56 | 216 | n.d. | n.d. |
| B-7 | 9 | 1.575 | 2.69 | 5.28 | 8.02 | 7.35 | 31.53 | 211 | n.d. | n.d. |
| B-8 | 11 | 1.75 | 2.63 | 5.57 | 8.04 | 7.40 | 32.67 | 204 | 8.2 | 255 |
| B-9 | 12 | 1.275 | 2.59 | 5.58 | 8.22 | 7.71 | 34.25 | 205 | 8.2 | 255 |
| B-10 | 13 | 1.65 | 2.64 | 5.66 | 8.29 | 8.02 | 35.06 | 213 | 8.2 | 254 |
| B-11 | 15 | 1.6 | 2.70 | 5.55 | 8.40 | 7.68 | 33.71 | 208 | 8.1 | 253 |
| B-12 | 16 | 1.625 | 2.58 | 5.48 | 8.18 | 7.52 | 32.94 | 207 | 8.0 | 257 |
| B-13 | 18 | 1.7 | 2.68 | 5.54 | 8.01 | 7.50 | 32.71 | 208 | 8.2 | 254 |
| B-14 | 19 | 1.45 | 2.61 | 5.37 | 8.01 | 7.24 | 32.17 | 200 | 8.2 | 254 |
| B-15 | 20 | 1.625 | 2.66 | 5.53 | 8.04 | 7.62 | 32.93 | 212 | 8.3 | 255 |
| B-16 | 21 | 1.625 | 2.66 | 5.53 | 8.04 | 7.62 | 32.93 | 212 | 8 | 254 |
| B-17 | 22 | 1.875 | 2.62 | 5.56 | 8.34 | 7.53 | 33.49 | 203 | 8.1 | 254 |

Table 5 shows that the viscosity data of the formulations containing a DI package correlate with those without any package (see Table 4). That means that it can be seen that if the viscosity data of a formulation without any package are satisfying and with the specifications the corresponding data of a formulation with DI package are as well satisfying and within the specifications.

The following Table 6 gives an overview of the most relevant data. The microcoking test (MCT) is used here as a screener for piston deposits in engines, especially in diesel engines or turbocharged gasoline engines. From the data obtained it can be seen that introducing N-dispersant monomers to the polymers does not have a negative effect on the MCT merits obtained. In contrast, it was surprisingly found that introducing DMAEMA as dispersant monomer leads to a significant increase in the MCT merits and therefore an improvement of deposit performance in this screener.

TABLE 6

Summary overview of all data.

| Ex # | Formulation # (without DI) | $KV_{40}$ [$mm^2/s$] | $HTHS_{100}$ [mPas] | $HTHS_{80}$ [mPas] | Carbon black dispersancy (area under curve) | Formulation # (with DI) | MCT results: Average Merit | MCT results: Average Deposit temperature | Styrene | BMA | Sum |
|---|---|---|---|---|---|---|---|---|---|---|---|
| 1 | A-1 | — | — | — | 42.80 | | | | 11.0 | 43.8 | 54.8 |
| 2 | A-2 | 27.83 | 4.98 | 7.09 | 32.32 | B-1 | 8.4 | 252 | 10.7 | 42.5 | 53.2 |
| 3 | A-3 | 27.45 | 4.96 | 7.12 | 34.01 | | | | 10.8 | 43.1 | 53.9 |
| 4 | A-4 | 23.56 | 4.35 | 6.31 | | B-2 | 8.5 | 261 | 11.0 | 55.4 | 66.4 |
| 5 | A-5 | 24.74 | 4.78 | 6.57 | 8.40 | B-3 | 8.9 | 264 | 11.0 | 45.4 | 56.4 |

TABLE 6-continued

Summary overview of all data.

| Ex # | Formulation # (without DI) | $KV_{40}$ [$mm^2/s$] | $HTHS_{100}$ [mPas] | $HTHS_{80}$ [mPas] | Carbon black dispersancy (area under curve) | Formulation # (with DI) | MCT results Average Merit | MCT results Average Deposit temperature | Styrene | BMA | Sum |
|---|---|---|---|---|---|---|---|---|---|---|---|
| 6 | | | | | | B-4 | 8.7 | 259 | 11.0 | 53.4 | 64.4 |
| 7 | | | | | | B-5 | 8.8 | 266 | 11.0 | 50.8 | 61.8 |
| 8 | A-6 | 23.08 | 4.15 | 6.13 | 27.84 | B-6 | | | 11.0 | 55.4 | 66.4 |
| 9 | A-7 | 24.75 | 4.82 | 6.50 | 27.32 | B-7 | | | 11.0 | 45.4 | 56.4 |
| 10 | A-8 | 23.97 | 4.32 | 6.39 | 28.13 | | | | 0.2 | 59.6 | 59.8 |
| 11 | A-9 | 24.44 | 4.83 | 6.56 | 21.62 | B-8 | 8.2 | 255 | 20.0 | 41.9 | 61.9 |
| 12 | A-10 | 31.71 | 5.07 | 7.20 | 29.97 | B-9 | 8.2 | 255 | 19.7 | 34.3 | 54.0 |
| 13 | A-11 | 27.89 | 5.08 | 7.27 | | B-10 | 8.2 | 254 | 19.4 | 33.8 | 53.2 |
| 14 | | | | | | | 8.0 | 254 | 19.4 | 33.8 | 53.2 |
| 15 | | | | | | B-11 | 8.1 | 253 | 19.4 | 37.6 | 57 |
| 16 | | | | | | B-12 | 8.0 | 257 | 19.4 | 41.5 | 60.9 |
| 17 | A-12 | 24.58 | 4.35 | 6.48 | 26.71 | | | | 0.2 | 39.6 | 39.8 |
| 18 | A-13 | 24.64 | 4.77 | 6.54 | 32.13 | B-13 | 8.2 | 254 | 22.5 | 38.4 | 60.9 |
| 19 | A-14 | 24.52 | 4.78 | 6.50 | 23.93 | B-14 | 8.2 | 254 | 25.0 | 34.9 | 59.9 |
| 20 | A-15 | 24.82 | 4.84 | 6.62 | 25.62 | B-15 | 8.3 | 255 | 27.5 | 31.4 | 58.9 |
| 21 | A-16 | 24.68 | 4.78 | 6.54 | 25.43 | B-16 | 8 | 254 | 27.5 | 31.4 | 58.9 |
| 22 | | | | | | B-17 | 8.1 | 254 | 26.7 | 33.8 | 60.5 |
| 23 | A-17 | 24.05 | 4.58 | 6.56 | 9.60 | | | | 10.0 | 55.7 | 65.7 |
| 24 | A-18 | 24.16 | 4.54 | 6.48 | | | | | 20.0 | 45.7 | 65.7 |
| 25 | A-19 | 24.02 | 4.56 | 6.47 | 16.82 | | | | 30.0 | 35.7 | 65.7 |
| 26*) | A-20 | 23.98 | 4.41 | 6.40 | 35.28 | | | | 0.2 | 66.2 | 66.4 |
| 27*) | A-21 | 28.4 | 5.14 | 7.45 | 30.77 | | | | 39.8 | 17.8 | 57.6 |
| 28*) | A-22 | | | | 9.89 | | | | 34.6 | 18.2 | 52.8 |
| 29*) | A-23 | 25.58 | 4.75 | 7.02 | | | | | 11.0 | 42.0 | 53.0 |
| 30*) | A-24 | 26.42 | 4.80 | 6.9 | 8.09 | | | | 20.0 | 37.6 | 57.6 |
| 31*) | A-25 | 25.94 | 4.76 | 6.73 | 14.36 | | | | 30.0 | 27.6 | 57.6 |
| 32*) | A-26 | — | — | — | 9.46 | | | | 10.0 | 47.6 | 57.6 |
| 33*) | A-27 | 24.97 | 4.77 | 6.82 | 38.35 | | | | 40.0 | 25.7 | 65.7 |
| 34*) | A-28 | 25.20 | 4.56 | 6.5 | 37.95 | | | | 1.3 | 63.1 | 64.4 |

*)comparative example

The invention claimed is:

1. A polyalkyl(meth)acrylate polymer, comprising the following monomers:

(a) 10to 25% by weight of the esters of (meth)acrylic acid and a hydroxylated hydrogenated polybutadiene;

(b) 45% to 60% by weight of the $C_{1-4}$ alkyl (meth) acrylates;

(c) 10% to 15% by weight of the styrene;

(d) 15% to 30% by weight of the $C_{10-30}$ alkyl (meth) acrylates; and (e) 3% to 7% by weight of the N-containing monomers selected from the group consisting of N,N-dimethylaminoethvl methacrylate (DMAEMA), N-(3-(dimethylamino)propyl)methacrylamide (DMAPMAm), and N-vinylpyrrolidinone (NVP), wherein the weight-average molecular weight of the polyalkyl(meth)acrylate polymer is in the range of 200,000 to 700,000 g/mol.

2. The polyalkyl (meth)acrylate polymer according to claim 1, wherein the number-average molecular weight is in the range of 20,000 to 200,000 g/mol.

3. A process for improving deposit formation of a lubricating oil composition, the process comprising:

adding the polyalkyl(meth)acrylate polymer according to claim 1 to the lubricating oil composition, wherein the polyalkyl(meth)acrylate polymer comprises N,N-dimethylaminoethyl methacrylate (DMAEMA) as the N-containing monomers.

4. An additive composition, comprising:

(A) 60 to 80% by weight of a base oil, and (B) 20 to 40% by weight of the polyalkyl(meth)acrylate polymer of claims 1.

5. A lubricating oil composition, comprising:

(A) 80 to 99.5% by weight of a base oil;

(B) 0.5 to 5% by weight of the polyalkyl(meth)acrylate comb polymer of claim 1; and (C) 0 to 15% by weight of one or more further additives.

6. The lubricating oil composition according to claim 5, comprising between 3% and 5% by weight of the polyalkyl (meth)acrylate comb polymer, wherein the lubricating oil composition does not comprise a DI package.

7. The lubricating oil composition according to claim 5, comprising between 1% and 2% by weight of the polyalkyl (meth)acrylate comb polymer, wherein the lubricating oil composition further comprises a DI package.

8. The polyalkyl(meth)acrylate polymer according to claim 1, wherein the $C_{10-30}$ alkyl (meth)acrylates are $C_{12-14}$ alkyl methacrylates.

9. The polyalkyl(meth)acrylate polymer according to claim 1, wherein the N-containing mono er is DMAEMA.

10. The polyalkyl(meth)acrylate polymer according to claim 1, comprising the following monomers:

(a) 10 to 20% by weight of the esters of (meth)acrylic acid and a hydroxylated hydrogenated polybutadiene;

(b) 45% to 55% by weight of the $C_{1-4}$ alkyl (meth) acrylates;

(c) 10% to 15% by weight of the styrene;

(d) 15% to 25% by weight of $C_{12-14}$ alkyl methacrylates; and (e) 3% to 7% by weight of N,N-dimethylaminoethyl methacrylate (DMAEMA).

11. The polyalkyl(meth)acrylate polymer according to claim 1, consisting of the following monomers:

(a) 10 to 25% by weight of the esters of (meth)acrylic acid and a hydroxy lated hydrogenated polybutadiene;

(b) 45% to 60% by weight of the $C_{1-4}$ alkyl (meth) acrylates;

(c) 10% to 15% by weight of the styrene;

(d) 15% to 30% by weight of the $C_{10-30}$ alkyl (meth) acrylates; and (e) 3% to 7% by weight of the N-containing monomers selected from the group consisting of N,N-dimethylaminoethyl methacrylate (DMAEMA), N-(3-(dimethylamino)propyl)methacrylamide (DMAPMAm), and N-vinyl pyrrolidinone (NVP).

12. A polyalkyl(meth)acrylate polymer, comprising the following monomers:

(a) 10 to 25% by weight of the esters of (meth)acrylic acid and a hydroxylated hydrogenated polybutadiene;

(b) 30% to 45% by weight of the $C_{1-4}$ alkyl (meth) acrylates;

(c) 19% to 30% by weight of the styrene;

(d) 15% to 30% by weight of the $C_{10-30}$ alkyl (meth) acrylates; and (e) 3% to 7% by weight of the N-containing monomers selected from the group consisting of N,N-dimethylaminoethyl methacrylate (DMAEMA), N-(3-(dimethylamino)propyl)methacrylamide (DMAPMAm), and N-vinylpyrrolidinone (NVP), wherein the weight-average molecular weight of the polvalkyl(meth)acrylate polymer is in the range of 200,000 to 700,000 g/mol.

13. A process for improving deposit formation of a lubricating oil composition, the process comprising:

adding the polyalkyl(meth)acrylate polymer according to claim 12 to the lubricating oil composition, wherein the polyalkyl(meth)acrylate polymer comprises N,N-dimethylaminoethyl methacrylate (DMAEMA) as the N-containing monomers.

14. An additive composition, comprising:

(A) 60 to 80% by weight of a base oil, and (B) 20 to 40% by weight of the polyalkyl(meth)acrylate polymer of claim 12.

15. A lubricating oil composition, comprising:

(A) 80 to 99.5% by weight of a base oil;

(B) 0.5 to 5% by weight of the polyalkyl(meth)acrylate polymer of claim 12; and (C) 0 to 15% by weight of one or more further additives.

16. The polyalkyl(meth)acrylate polymer according to claim 12, wherein the number-average molecular weight is in the range of 20,000 to 200,000 g/mol.

17. The polyalkyl(meth)acrylate polymer according to claim 12, wherein the $C_{10-30}$ alkyl (meth)acrylates are $C_{12-14}$ alkyl methacrylates.

18. The polyalkyl(meth)acrylate polymer according to claim 12, wherein the N-containing monomer is DMAEMA.

19. The polyalkyl(meth)acrylate polymer according to claim 12, consisting of the following monomers:

(a) 10 to 25% by weight of the esters of acrylic acid and a hydroxylated hydrogenated polybutadiene;

(b) 30% to 45% by weight of the $C_{1-4}$ alkyl (meth) acrylates;

(c) 19% to 30% by weight of the styrene;

(d) 15% to 30% by weight of the $C_{10-30}$ alkyl (meth) acrylates; and (e) 3% to 7% by weight of the N-containing monomers selected from the group consisting of N,N-dimethylaminoethyl methacrylate (DMAEMA), N-(3-(dimethylamino)propyl)methacrylamide (DMAPMAm), and N-vinylpyrrolidinone (NVP).

* * * * *